US005544362A

United States Patent [19]

Synek

[11] Patent Number: 5,544,362

[45] Date of Patent: Aug. 13, 1996

[54] BALL GLOVE WITH WEB ASSEMBLY

[76] Inventor: Richard J. Synek, 1024 Whitfield Rd., Northbrook, Ill. 60062

[21] Appl. No.: 321,563

[22] Filed: Oct. 12, 1994

[51] Int. Cl.[6] ..... A41D 13/08

[52] U.S. Cl. ..... 2/19

[58] Field of Search ..... 2/16, 19, 161.1; D2/361

[56] References Cited

U.S. PATENT DOCUMENTS

| | | | |
|---|---|---|---|
| D. 153,186 | 3/1949 | Sonnett . | |
| 1,426,824 | 8/1922 | Doak | 2/19 |
| 1,545,998 | 7/1925 | Barrett | 2/19 |
| 1,567,658 | 12/1925 | Latina | 2/19 |
| 2,414,004 | 1/1947 | Turner . | |
| 2,452,695 | 11/1948 | Sonnett et al. | 2/19 |
| 2,459,887 | 1/1949 | Latina | 2/19 |
| 2,473,025 | 6/1949 | Gregg | 2/19 |
| 2,510,218 | 6/1950 | Goldsmith et al. . | |
| 2,558,544 | 6/1951 | Delsalle . | |
| 3,098,234 | 7/1963 | Latina | 2/19 |
| 3,321,771 | 5/1967 | Latina . | |
| 3,588,915 | 6/1971 | Latina | 2/19 |
| 3,623,163 | 11/1971 | Latina | 2/19 |
| 4,896,376 | 1/1990 | Miner . | |
| 5,357,634 | 10/1994 | Aoki | 2/19 |

*Primary Examiner*—C. D. Crowder
*Assistant Examiner*—Larry D. Worrell, Jr.
*Attorney, Agent, or Firm*—Olson & Hierl, Ltd.

[57] ABSTRACT

A ball glove or mitt comprising a body and a flexible reticulate web assembly that extends beyond the thumb and finger portions of the mitt. The web assembly preferably is constituted by a central patch and radially outwardly extending filaments that connect the patch to the body and to the thumb and finger portions of the mitt.

17 Claims, 3 Drawing Sheets

BALL GLOVE WITH WEB ASSEMBLY

FIELD OF THE INVENTION

The present invention relates to a ball glove, and more particularly to a glove suitable for instructional use as well as play.

BACKGROUND OF THE INVENTION

In most baseball and softball gloves, a web or backstop is provided between the thumb and the fingers of the glove. The purpose of the web is to provide a region in which the ball can be caught and also to receive the initial impact energy of the moving ball. U.S. Pat. Nos. 2,414,004; 2,510,218; 2,558,544; 3,321,771; 4,896,376, and Des. 153,186 disclose examples of many of the various types of ball mitts or gloves known in the art.

One of the shortcomings of the prior art baseball mitts, however, is that the baseball mitt is not suitably constructed for instructional use, especially for young children learning the game of baseball. Instead, virtually all of the known baseball mitts are better suited for use by persons who already know how to catch a baseball. Such mitts therefore are also designed to enable a skilled player to remove a caught baseball quickly and easily. This is, of course, important to an experienced player.

As a result, use of the currently available mitts can be quite frustrating for young children with little or no baseball playing experience because of the difficulty involved in learning how to catch a ball. Accordingly, what is needed is a ball mitt designed for young children with little or no experience in catching a ball.

It, therefore, is an object of this invention to provide a ball mitt that can be used as an instructional mitt for young children who are learning the game of baseball, softball, and like games.

It is a further object of the present invention to provide a ball glove with a web configuration that enhances the ability to catch a ball such as a baseball, softball, broomball, and the like.

SUMMARY OF THE INVENTION

The present invention contemplates a flexible, reticulate web configuration that preferably includes a central patch and filaments extending outwardly therefrom. These filaments join the central patch to a thumb portion and to a finger portion of a ball catching glove.

The present glove or mitt has a web assembly that enhances the player's ability to catch a ball. Because of the inherent flexibility provided by the web assembly, the mitt will collapse readily when the impact of the ball is received in the web. The thumb and outer finger of the glove become superposed over one another and secure the ball within the web. Moreover, with this construction, the web extends away from the palm portion of the glove beyond the thumb and finger portions, thus providing a web that is larger than the more solid and less flexible webs of conventional baseball gloves.

BRIEF DESCRIPTION OF THE DRAWINGS

The present invention and the advantages thereof will become more apparent upon consideration of the following detailed description when taken in conjunction with the accompanying drawings, in which.

DESCRIPTION OF THE PREFERRED EMBODIMENT

Figure 2:
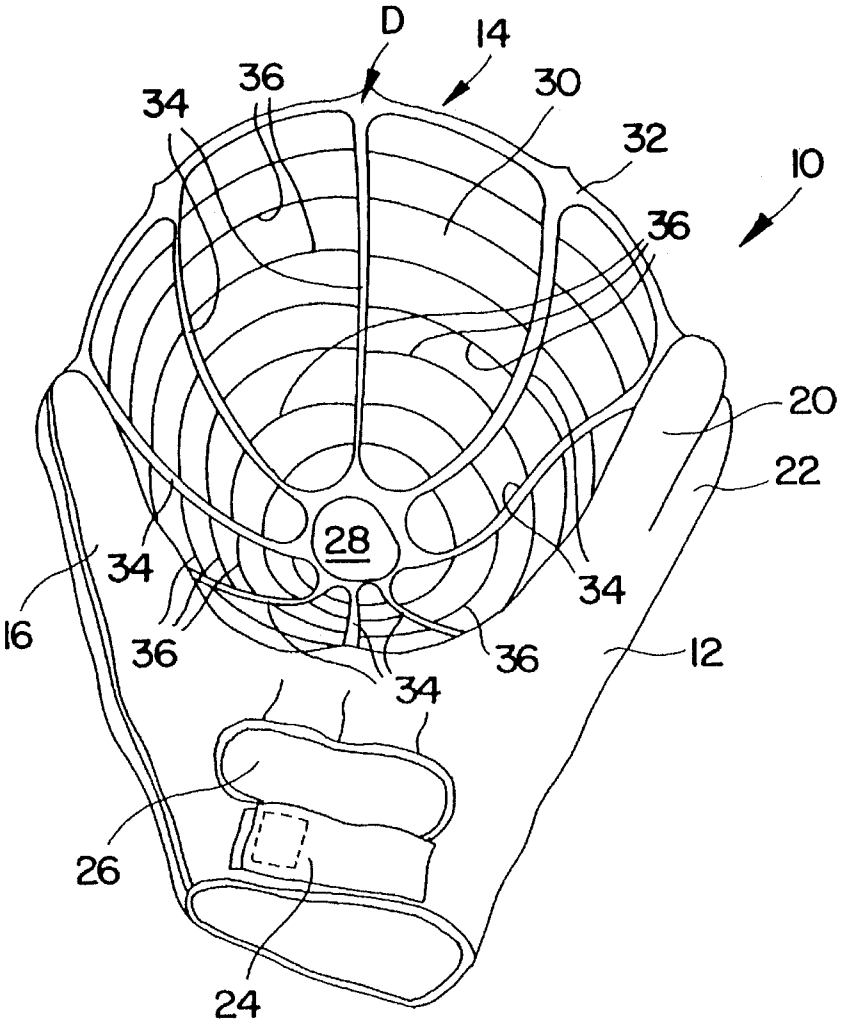
FIG. 2 is an elevation view of the back of the ball mitt similar to that of FIG. 1 but for use on the right hand.
Figure 1:
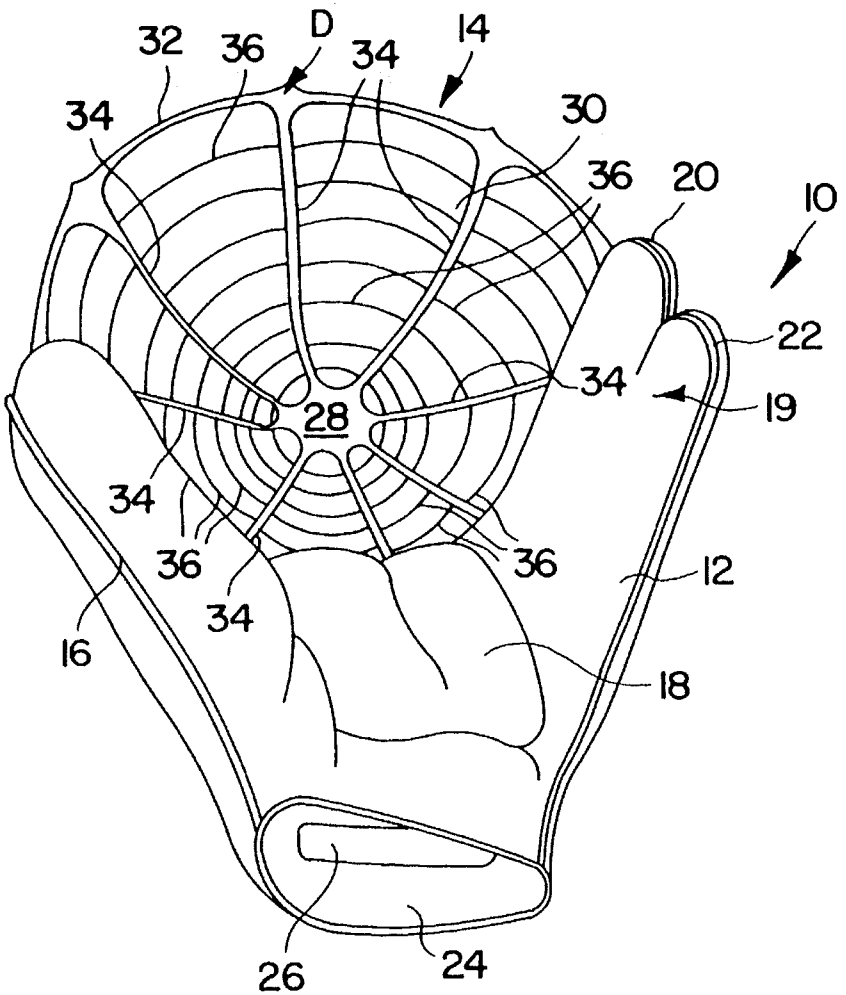
FIG. 1 is an elevation view of the front or "palm" side of a ball mitt in accordance with a preferred embodiment of the invention for use on the left hand.
Figure 4:
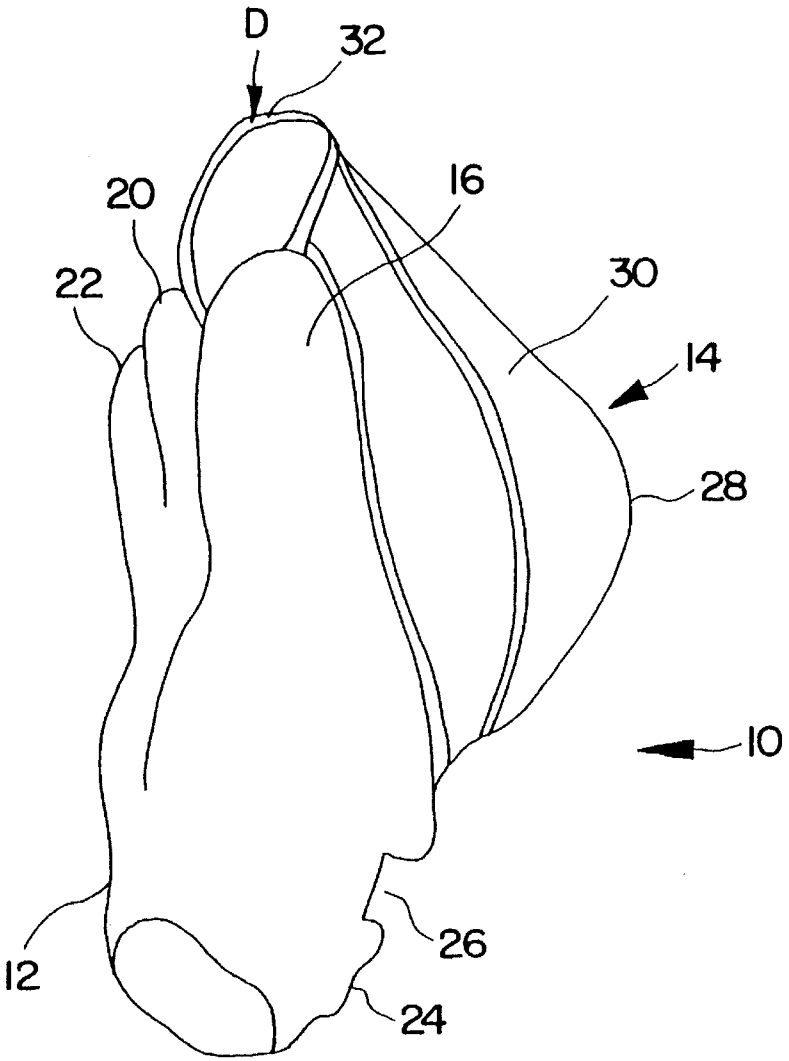
FIG. 4 is a view of the other side of the ball mitt of FIG. 2.
Figure 3:
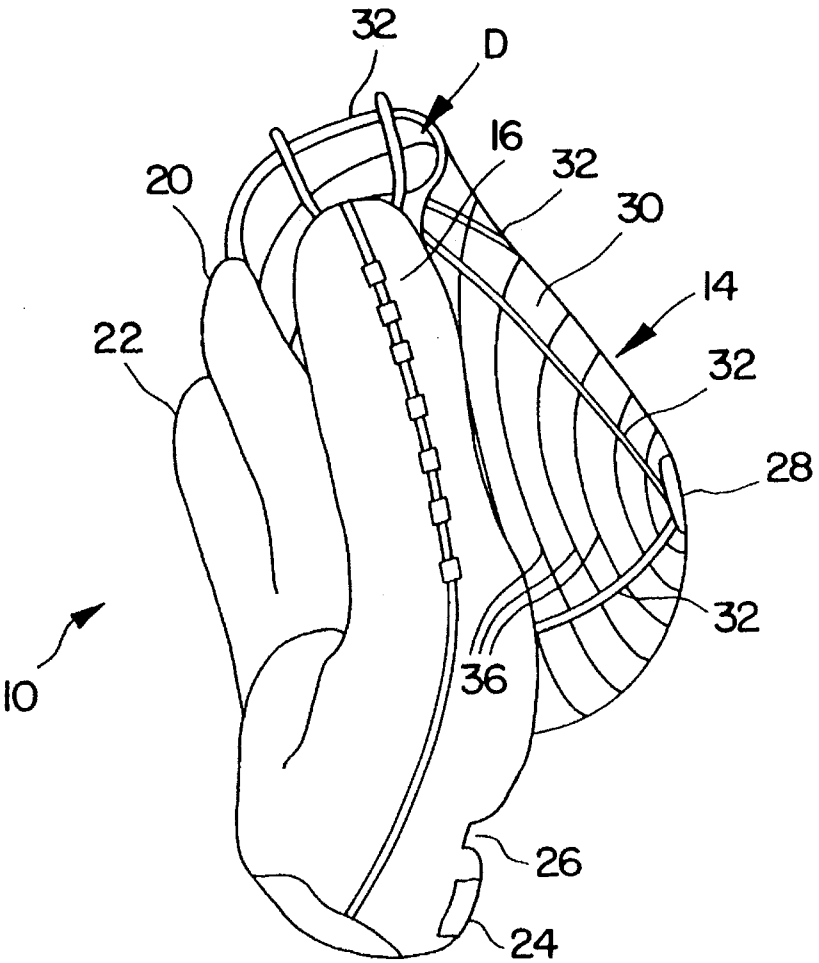
FIG. 3 is a side view of one side of the ball mitt of FIG. 2.

The ball mitt 10, as shown in FIGS. 1–4, comprises a glove body 12 and web 14. Preferably, body 12 is constructed of leather, and reticulate web assembly 14 of a plastic material. The body 12 of the mitt comprises a padded thumb portion 16, a padded palm region 18, and a padded finger portion 19. In the embodiment shown in FIGS. 1–4, two padded fingers 20, 22 are shown with each padded finger being adapted to receive two fingers of the player. If desired, an adjustable strap 24, e.g., a strap provided with hook and loop fasteners or the like, can be provided at the wrist of the mitt adjacent a wrist aperture 26 to secure the mitt on the user's hand. The mitt 10, of course, can be constructed for use on the left hand, as shown in FIG. 1, or the right hand, as shown in FIGS. 2–4.

The web assembly 14 comprises a central patch 28 and a flexible web filament network 30 interconnecting the central patch with the mitt body 12. The web assembly includes a perimeter string 32 that may be adjustable, and a plurality of radially outwardly extending web strings 34 interconnecting the central patch 28 with the perimeter string 32 as well as with glove body 12. A plurality of threads 36 extends between adjacent web strings or filaments and maintain the web strings in a spaced relationship relative to one another. A number of web filaments 34 is connected to the thumb portion or to the finger portion, while some of the remaining web filaments are either connected to the palm region 18 or extend radially outwardly away from central patch 28 and join perimeter string 32. Preferably, the number of web filaments connected to the thumb portion 16 and the finger portion 19 is the same.

Preferably, there are eight web strings 34, each having a diameter approximately equal to that of the perimeter string 32, and six threads 36 having a diameter less than that of the web strings 34. When the web assembly 14 is flexed, the threads 36 interconnecting each pair of web strings extend generally parallel to each other and generally perpendicular to the web strings 34. Preferably, central patch 28 is generally octagonal, with each web string 34 being secured to a corresponding corner of the patch. Alternatively, the patch may be circular or of any other regular or irregular shape, as desired.

In the preferred embodiment, the area of web assembly 14 comprises no more than about one-quarter material (i.e., strings 32, 34 and threads 36) and the remaining three-quarters of the area is void of material. As a result, the baseball mitt 10 is relatively lightweight and folds easily. Desirably, the depth of a pocket defined by web assembly 14 is greater in magnitude than the thickness of the body of the mitt.

A portion of the web assembly 14 is secured to the body of mitt 12 in any suitable manner such as by stitching. One portion of perimeter string 32 is secured to thumb portion 16 and another portion to finger portion 19. In the preferred embodiment, the perimeter of the web assembly 14 is stitched to the body of the mitt along approximately one half the length of the perimeter string 32. The unstitched portion of the perimeter string extends outwardly between thumb portion 16 and finger portion 19 in a generally arcuate manner away from palm region 18.

The present inventive construction provides a web assembly 14 in a baseball mitt that enhances the player's ability to catch a ball. Because of the inherent flexibility provided by the web assembly 14, the mitt 10 will collapse in response to the impact of a ball, so that the thumb portion 16 and outer finger 22 become substantially flush with one another and secure the ball inside the pocket defined by the web assembly 14. Moreover, with this construction, the distal portion D of the reticulate web assembly 14 extends beyond the thumb 16 and fingers 20, 22, thereby providing a reticulate web assembly that is larger, relative to the size of the body of the mitt, than the prior art mitts, and substantially more flexible.

The depth of the pocket defined by web assembly 14 can be adjustable by foreshortening of perimeter string 32.

Figure 5:
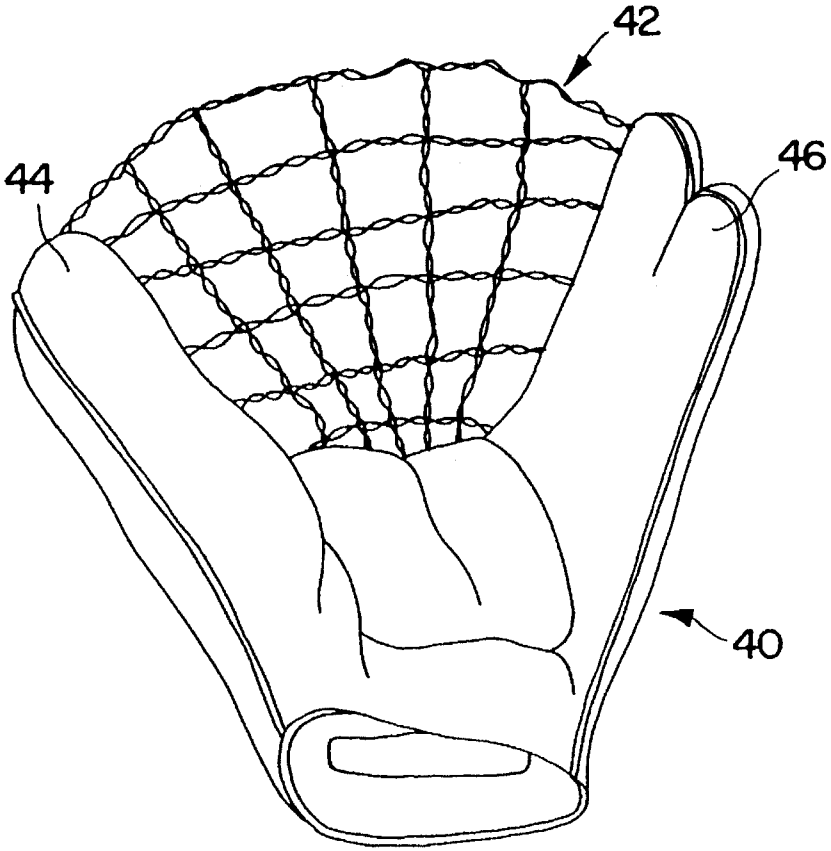
FIG. 5 shows an alternate embodiment of the present invention having netting that connects the thumb portion to the finger portion of a ball catching glove.

An alternate embodiment is shown in FIG. 5 where ball glove 40 is provided with a reticulate web 42 that connects thumb portion 44 with finger portion 46 and is secured thereto. Reticulate web 42 can be made of netting of the type utilized to define the pocket of a lacrosse stick or the like. A drawcord can be provided in operable association with the netting to define a pocket.

Figure 6:
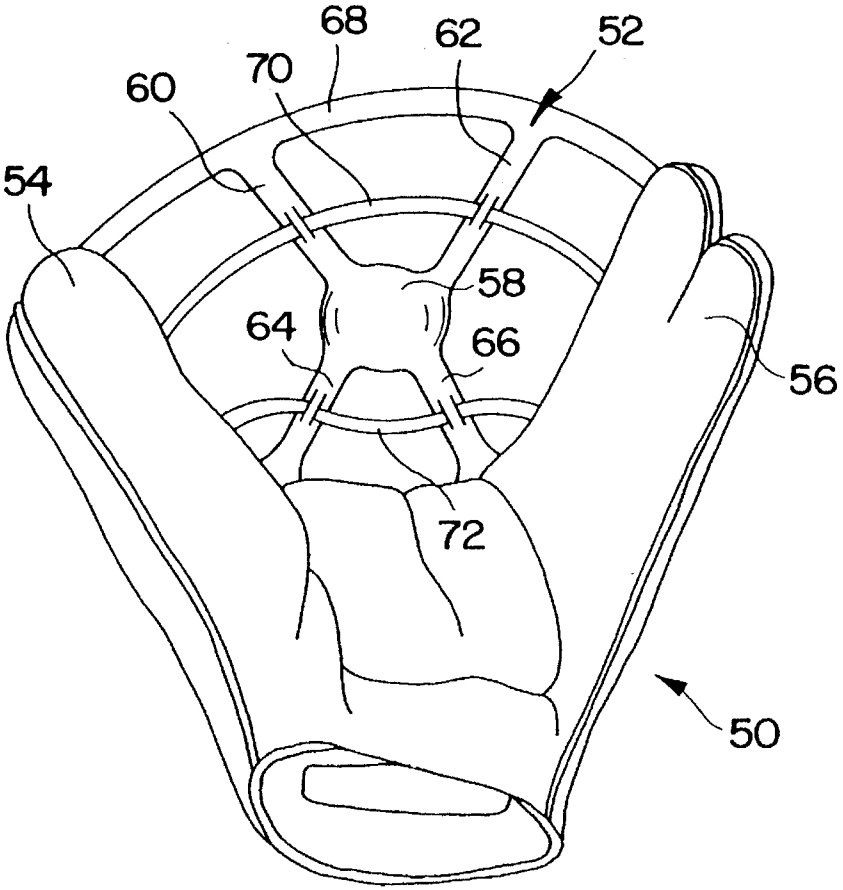
FIG. 6 shows yet another embodiment of the present invention having a flexible web assembly provided with individually adjustable filaments.

Still another embodiment of the present invention is illustrated in FIG. 6. Ball glove 50 is provided with reticulate web assembly 52 that connects thumb portion 54 with finger portion 56. Reticulate web assembly 52 includes central patch 58 unitary with radially outwardly extending bands or strips 60, 62, 64 and 66 as well as with peripheral band or strip 68. Additional bands 70 and 72 extend transversely across from the thumb portion 54 to the finger portion 56 and are laced through strips 60 and 62, and through strips 64 and 66, respectively, and can be made adjustable in length.

The foregoing description is for purposes of illustration only and is not intended to limit the scope of protection accorded this invention. The scope of protection is to be measured by the following claims, which should be interpreted as broadly as the inventive contribution permits.

What is claimed is:

1. A ball glove having spaced-apart thumb and finger portions, a palm region joined to the thumb and finger portions, and a flexible reticulate web assembly extending between the thumb and finger portions and the palm region, said web assembly comprising a central patch spaced apart from the thumb and finger portions and the palm region and web filaments extending outwardly from the central patch and connecting the central patch to the thumb and finger portions and the palm region, the web filaments defining a plurality of voids;

the web assembly having an area defined by the central patch and the web filaments, with about three-quarters of the defined area being a void area.

2. The ball glove in accordance with claim 1 wherein some of the web filaments are attached to the thumb portion and some of the other web filaments are attached to the finger portion, the number of web filaments attached to the thumb portion and the number of web filaments attached to the finger portion being the same.

3. The ball glove in accordance with claim 1 wherein a plurality of threads extend between and join adjacent web filaments.

4. The ball glove in accordance with claim 1 wherein the thumb and finger portion have substantially the same thickness and the web assembly defines a pocket that has a depth greater than said thickness.

5. The ball glove of claim 1 wherein the central patch is generally octagonal and wherein eight web filaments extend substantially radially away from the central patch, each web filament being secured to one corner of the patch.

6. The ball glove of claim 1 wherein the reticulate web assembly is netting secured to the thumb and finger portions of said glove.

7. The ball glove of claim 1 wherein the reticulate web assembly comprises a central patch with unitary, radially outwardly extending bands and a peripheral band, as well as bands laced through said radially outwardly extending bands.

8. A ball glove comprising:

a body, including a thumb portion, an inner finger, an outer finger and a palm region joined to the thumb and inner and outer fingers; and a flexible reticulate web assembly that comprises:

a peripheral string forming an outer perimeter of the flexible web assembly;

a central patch that is spaced apart from the thumb portion, inner finger, palm region and peripheral string; and web filaments that extend radially outwardly from the central patch and connect the central patch to the thumb portion, to the inner finger, to the palm region and to the peripheral string, the web filaments defining a plurality of voids;

said web assembly being contoured so that the thumb and outer finger become substantially flush with one another when a baseball is caught to secure the ball within the glove;

the web assembly having an area defined by the central patch and the web filaments, with about three-quarters of the defined area being a void area.

9. The ball glove of claim 8 wherein a plurality of threads interconnect the web filaments.

10. The ball glove of claim 9 wherein the threads that interconnect the same two filaments are generally parallel to each other.

11. The ball glove of claim 9 wherein the diameters of the threads are less than the diameters of the filaments.

12. The ball glove of claim 8 wherein the web assembly extends outwardly beyond the thumb portion and the inner finger.

13. A ball glove comprising:

a body, including a thumb portion, an inner finger, an outer finger and a palm region joined to the thumb and inner and outer fingers; and a flexible reticulate web assembly that comprises:

a peripheral string forming an outer perimeter of the flexible web assembly;

a central patch that is spaced apart from the thumb portion, inner finger, palm region and peripheral string, the central patch being generally octagonal; and eight web filaments that extend radially outwardly from the corners of the central patch and connect the central patch to the thumb portion, to the inner finger, to the palm region and to the peripheral string;

said web assembly being contoured so that the thumb and outer finger become substantially flush with one another when a baseball is caught to secure the ball within the glove.

14. The ball glove of claim 13 wherein a plurality of threads interconnect the web filaments.

15. The ball glove of claim 14 wherein the threads that interconnect the same two filaments are generally parallel to each other.

16. The ball glove of claim 14 wherein the diameters of the threads are less than the diameters of the filaments.

17. The ball glove of claim 13 wherein the web assembly extends outwardly beyond the thumb portion and the inner finger.

* * * * *